US005265303A

United States Patent [19]

Neff

[11] Patent Number: 5,265,303

[45] Date of Patent: Nov. 30, 1993

[54] PIPELINE PIG IMPLEMENT AND RETAINING APPARATUS

[76] Inventor: Laurence M. Neff, 14602 S. Grant, Bixby, Okla. 74006

[21] Appl. No.: 928,986

[22] Filed: Aug. 12, 1992

[51] Int. Cl.[5] ..... B08B 9/04

[52] U.S. Cl. ..... 15/104.061

[58] Field of Search ..... 15/104.061, 104.062, 15/104.063, 3.5, 3.51; 166/153, 170, 202

[56] References Cited

U.S. PATENT DOCUMENTS

| | | | |
|---|---|---|---|
| 1,696,677 | 12/1928 | Hayton | 15/104.061 |
| 2,552,339 | 5/1951 | Moon | 15/104.061 |
| 2,575,624 | 11/1951 | Hall | 15/104.061 |
| 3,643,280 | 2/1972 | Powers | 15/104.061 |
| 3,691,584 | 9/1972 | Landers | 15/104.061 |
| 4,275,475 | 6/1981 | Schwartz et al. | 15/104.06 R |
| 4,365,379 | 12/1982 | Neff | 15/104.06 R |
| 4,506,401 | 3/1985 | Knapp | 15/104.061 |
| 4,538,316 | 9/1985 | Reinhart | 15/104.061 |
| 4,573,231 | 3/1986 | Stocksiefen et al. | 15/104.061 |
| 4,726,089 | 2/1988 | Knapp | 15/104.061 |

*Primary Examiner*—Edward L. Roberts

*Attorney, Agent, or Firm*—Bill D. McCarthy

[57] ABSTRACT

A pipeline pig assembly having an improved pig implement and retaining apparatus for retaining the pig implement, the improved retaining apparatus comprising a body extension member connectable to the body portion of the pipeline pig to support at least one pig implement. The pig implement is securely retained on the body extension member by a retaining collar fastened on the body extension member, and the pig implement has a pattern of recesses which are interlockable with retaining collar bosses or with bosses of a spacer member when multiple pig implements are supported.

28 Claims, 5 Drawing Sheets

PIPELINE PIG IMPLEMENT AND RETAINING APPARATUS

BACKGROUND OF THE INVENTION

1. Field of the Invention

The present invention relates generally to pipeline pigs, and more particularly, but not by way of limitation, to an improved pipeline pig implement and apparatus for retaining same on a pipeline pig.

2. Description of the Prior Art

The use of pipeline pigs, and their construction, has long been known in the petroleum industry. Generally, a pipeline pig is a device which is inserted into a pipeline and moved through the pipeline by liquids or gases.

Pipeline pigs are moved through a pipeline for a number of various purposes, such as cleaning the interior wall of the pipeline, separating one fluid component from another, displacing liquids which have condensed in a pipeline used to transport gas, and locating and removing obstructions in the pipeline. To more effectively accomplish these various tasks, different operating implements, such as cups and discs, are employed on a pipeline pig.

Pipeline pigs of the prior art are typically assembled by positioning the cups or other operating implements onto a metal pig body and securing the implements in place with a number of nuts and bolts in combination with several steel plates. While the assembly of a pipeline pig in this manner has generally been accepted by the industry, many inefficiencies are encountered in the use of such pig assemblies. For example, because of the number of parts used to retain the operating implements on the pig body, a relatively substantial amount of time is needed to replace the operating implements. Moreover, the large number of parts used leads to increased materials costs. Finally, the assembly of pipeline pigs as described above results in an inflexible structure which is unable to efficiently pass around corners and past irregularities in the pipeline, and thus has a tendency to get stuck in the pipeline.

The present invention, which is directed to an improved cup and retaining apparatus, overcomes the inherent deficiencies of prior art pipeline pigs; and thus, the present invention represents an advance in the state of the art relating to pipeline pigs.

SUMMARY OF THE INVENTION

According to the present invention an improved pig implement and an improved retaining apparatus for assemblying the pig implements on a pipeline pig are provided. The retaining apparatus comprises a body extension member, a retaining collar and a retaining band. The body extension member is adapted to be connected to a body portion of the pipeline pig and to receive the pig implements. The retaining collar is positionable over the body extension member so as to retain the implements thereon and is adapted to be secured to the body extension member. That is, in a preferred embodiment, the retaining collar is provided with a plurality of spaced apart flexible latching tabs having inwardly extending projections. The projections are received in projection receiving slots provided on the body extension member thereby fastening the retaining collar to the tubular body extension member. The retaining collar is also provided with an interlocking pattern of bosses. The retaining band is positioned about the retaining collar to prevent the outward deflection of the latching tabs while the pipeline pig is traveling through the pipeline. The improved pig implement has an interlocking pattern of recesses which is interlockable with the interlocking pattern of the retaining collar to secure the retaining collar and the pig implement in locked engagement.

An object of the present invention is to provide an improved pig implement which is quickly and easily operably secured on a pipeline pig.

Another object of the present invention, while achieving the above stated object, is to provide an apparatus for retaining the improved pig implement on the pipeline pig.

Yet another object of the present invention, while achieving the above stated objects, is to provide a pig implement and retaining apparatus which enables the pipeline pig to be moved through a pipeline with minimum force while achieving maximum contact with the interior wall of the pipeline.

Another object of the present invention, while achieving the above stated objects, is to provide a pig implement and retaining apparatus which is durable in construction, economical to manufacture, easy to assemble, and which overcomes the disadvantages of the prior art devices.

Other objects, advantages and features of the present invention will be apparent to those skilled in the art from the following detailed description when read in conjunction with the drawings and the appended claims.

DETAILED DESCRIPTION

Figure 1:
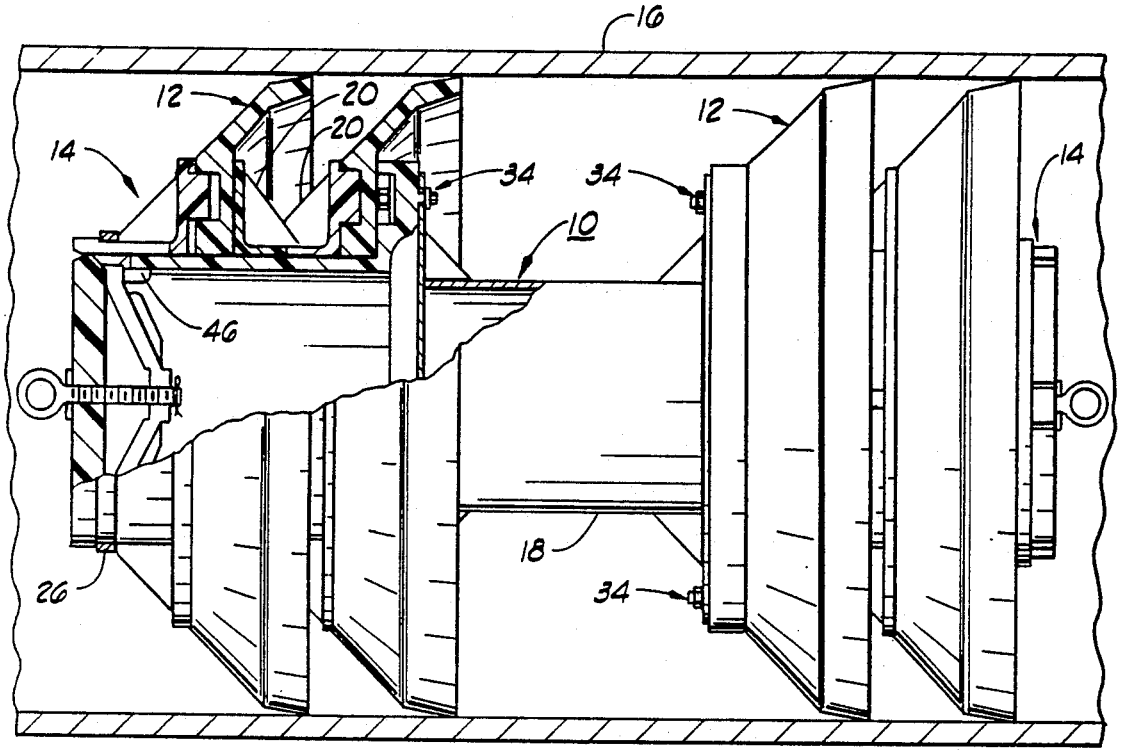
FIG. 1 is an elevational view, partially in cross section, of a pipeline pig disposed in a pipeline employing the retaining apparatus of the present invention to retain a plurality of cup implements thereon.

In the drawings, like numerals will be used throughout to designate like components.

Referring now to the drawings, and more particularly to FIG. 1, a pipeline pig 10 employing four cup implements 12 and two retaining apparatuses 14 constructed in accordance with the present invention is shown disposed in a pipeline 16. The pipeline pig 10 is further shown to include a conventional pig body 18 which is a tubular body commonly constructed of metal.

As stated above, a typical prior art pipeline pig is assembled by fastening one or two cups or other type of pig implements on each end of the pig body with a plurality of nuts an bolts in combination with several steel plates. As such, assembly of a typical prior art pipeline pig is often cumbersome and inefficient. On the other hand, as will be described in detail hereinbelow, the cup implements 12 as constructed in accordance with the present invention are quickly and easily assembled on each end of the pig body 18 by use of one of the retaining apparatuses 14 on each end thereof. The cup implements 12 are spaced apart from one another on the pig body 18 by a plurality of spacers 20. The retaining apparatuses 14, the spacers 20 and the cup implements 12 are configured so as to cooperatively secure the cup implements 12 on the pipeline pig 10 so that the cup implements 12 remain in maximum contact with the interior wall of the pipeline 16 while permitting the pipeline pig 10 to travel through the pipeline 16 with minimum force.

Referring now to FIGS. 2–8, the retaining apparatus 14 comprises a body extension member 22., a retaining collar 24 and a retaining band 26. The body extension member 22 is preferably a hollow, tubular member (best shown in FIG. 3A) and can be constructed of any suitable material, such as metal, but is preferably constructed of a durable and moldable material, such as plastic. An opening 28 extends through the body extension member 22 to allow pressure within the pipeline 16 to equalize with that on the interior of the body extension member 22 so that the pipeline pressure does not have a tendency to collapse the body extension member 22.

The body extension member 22 is provided with a flanged end portion 30 which is adapted to be connected to the end of the pig body 18. The flanged end portion 30 is provided with a plurality of holes 32 which are matable with the hole pattern of the pig body 18, and the flanged end portion 30 is attached to the pig body 18 by a plurality of nuts and bolts 34 (FIG. 1) An annular recess 36 is provided on the flanged end portion 30 in which the heads of the bolts 34 can set so that the cup implements 12 which are positioned adjacent the flanged end portion 30 will rest flush against the flanged end portion 30, as shown in FIG. 1.

Figure 3A:
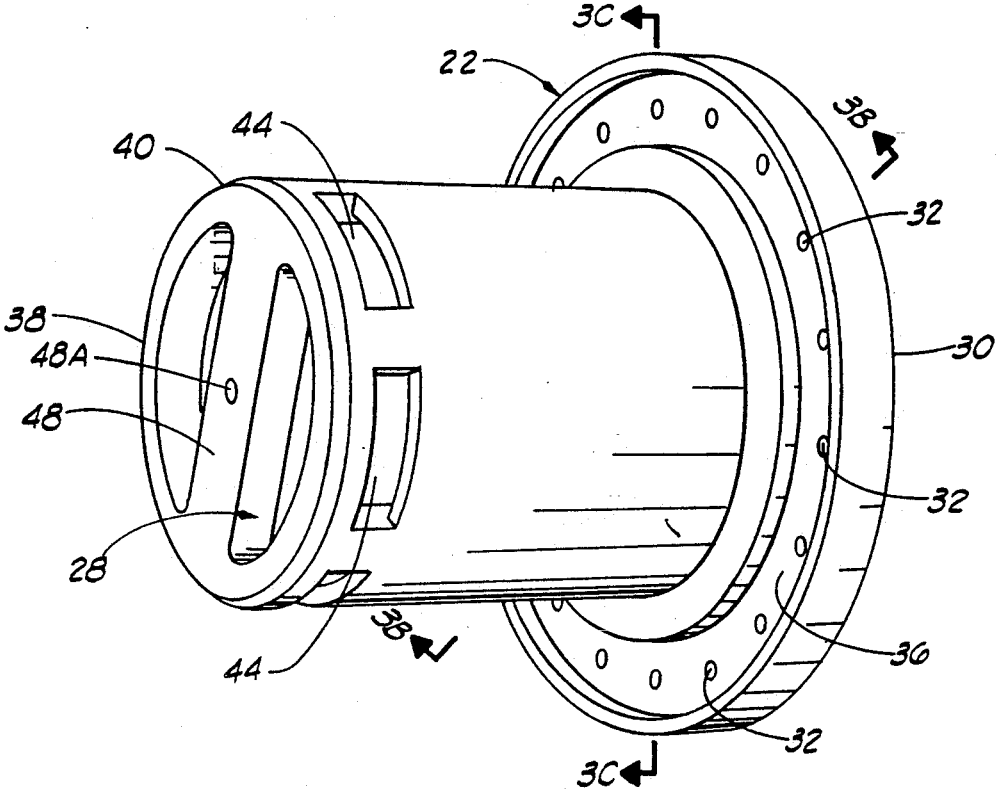
FIG. 3A is a perspective view of the body extension member of FIG. 1.
Figure 3B:
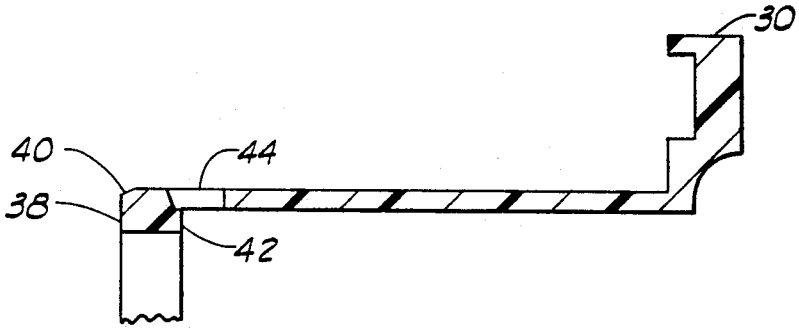
FIG. 3B is a fragmental profile along a cross section taken at 3B—3B in FIG. 3A.
Figure 3C:
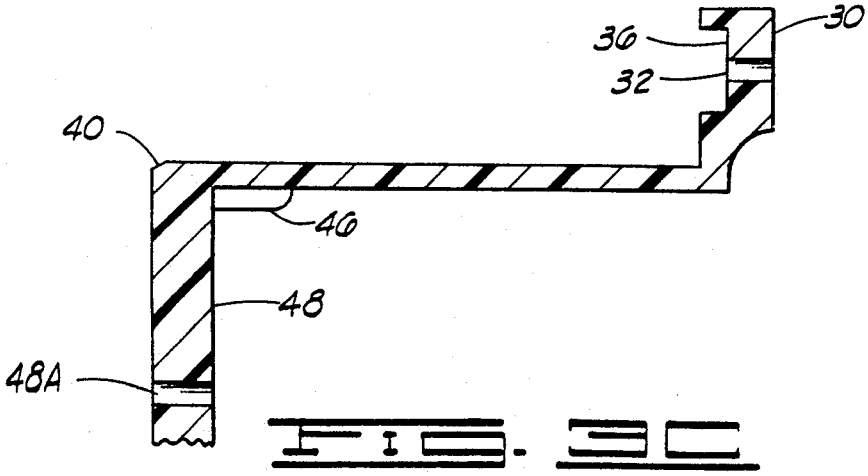
FIG. 3C is a fragmental profile along a cross section taken at 3C—3C in FIG. 3A.

At the other end of the body extension member 22, an inwardly extending flange portion 38 having a tapered outer edge 40 and an interior shoulder surface 42 is formed in order to provide strength to the end of the body extension member 22 (FIGS. 3B and 3C). The tapered outer edge 40 allows the retaining collar 24 to be more easily moved onto the body extension member 22. Adjacent the flange portion 38, a plurality of spaced apart projection receiving slots 44 are formed about the body extension member 22. The projection receiving slots 44 are configured to latch with the retaining collar 24 in a manner that will be described in detail hereinbelow.

A plurality of U-shaped ribs 46 are integrally formed on the interior wall of the body extension member 22. More specifically, the U-shaped ribs 46 are formed on the portion of the interior wall extending between the projection receiving slots 44, and extend from the inner shoulder surface 42 of the flange portion 38 to just beyond the projection receiving slots 44, as illustrated in FIG. 3C. The U-shaped ribs 46 provide additional strength to that portion of the body extension member 22 extending between the projection receiving slots 44, and they function as guides for an ejector assembly described hereinbelow which is used for facilitating the removal of the retaining collar 24 from the body extension member 22.

An integrally formed crossbar 48 is provided across the opening 28 to further strengthen the hollow body extension member 22 to prevent the inward deflection of the body extension member 22 while the pipeline pig 10 is traveling through the pipeline 16. The crossbar 48 additionally facilitates the removal of the pipeline pig 10 from the pipeline 16 by enabling one to hook the pipeline pig 10 by the crossbar 48 and remove same in a customary manner.

Figure 4A:
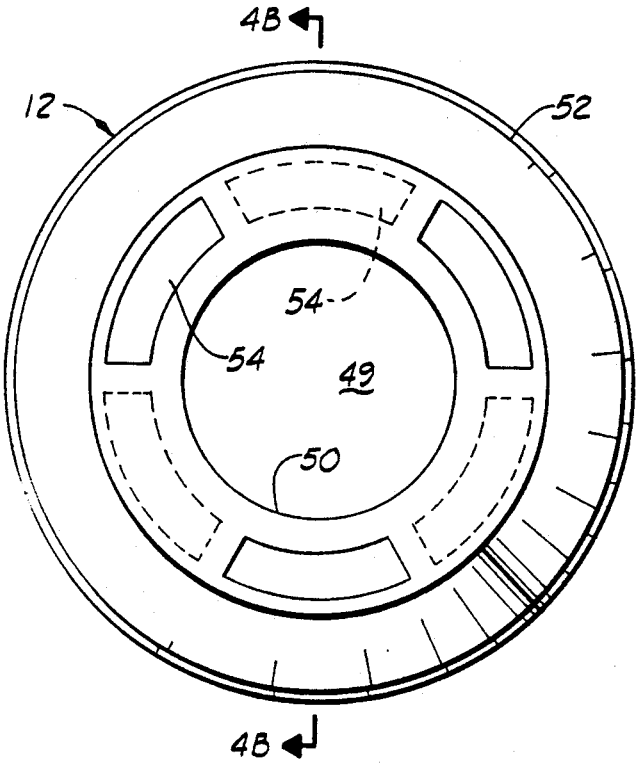
FIG. 4A is a front view of one of the cup implements constructed in accordance with the present invention and as shown in FIG. 1.
Figure 4B:
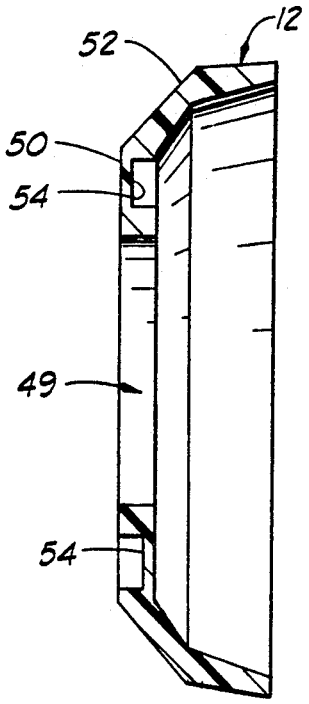
FIG. 4B is a cross sectional view taken at 4B—4B in FIG. 4A.

Each of the cup implements 12 has an opening 49 and is slidably positioned onto the body extension member 22, as shown in FIG. 1 and each such cup implement 12 has a body portion 50 and a pipeline engaging portion 52 (best shown in FIG. 4B). The configuration of the pipeline engaging portion 52 need not be described for purposes of the present invention, as such is well known in the art. Thus, no further description of the various shapes and types of cup implements or their function is believed necessary to enable one skilled in the art to understand the present invention. However, it should be noted that the body portion 50 of the cup implement 12 of the present invention is configured so as to be securely retainable on the pipeline pig 10 by use of the retaining apparatus 14 described herein. As shown in FIGS. 4A and 4B the body portion 50 of the cup implement 12 is provided with a pattern of recesses 54 thereon. The recesses 54 are configured to be interlockable with a corresponding portion of the retaining collar 24 and the spacers 20 in order to secure the cup implement 12 on the body extension member 22 when the retaining collar 24 is locked in position as described hereinbelow.

The pattern of recesses 54 of the cup implement 12 can vary widely; however, the recesses 54 are preferably staggered about the body portion 50, as shown in FIG. 4A, so that the recesses 54 are not disposed in a back-to-back relationship. This configuration enables the recesses 54 to be set in the body portion 50 with a depth which is approximately two-thirds the thickness of the body portion 50. A two-thirds depth maintains the strength of the cup implement 12, while providing a substantial area in which the interlocking portion of the retaining collar 24 and the spacers 20 can interlock with the cup implement 12.

While cup implements are being used in the description of the present invention, it will be understood by those skilled in the art that other pig implements employed on pipeline pigs, such as discs and brushes, can also be constructed so as to employ the inventive concept of the present invention.

Figure 5A:
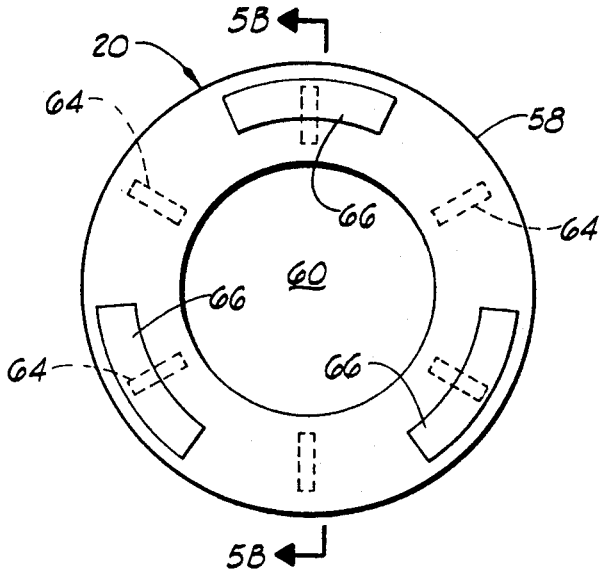
FIG. 5A is a front view of one of the spacers shown in FIG. 1.
Figure 5B:
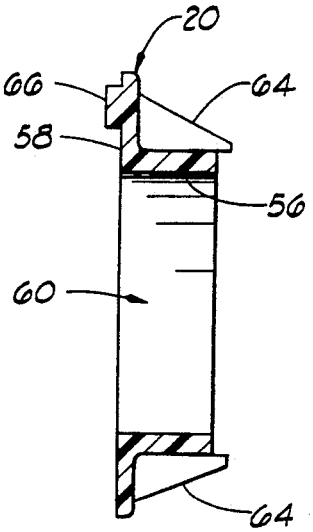
FIG. 5B is a cross sectional view taken at 5B—5B in FIG. 5A.

One of the spacers 20 is shown in FIG. 5A and 5B, and as shown, each spacer 20 includes a tubular portion 56 and a flange portion 58. The spacer 20 has an opening 60 therethrough which is dimensioned so that the spacer 20 can be slidably inserted onto the body extension member 22. The flange portion 58 is dimensioned to supportingly engage the body portion 50 of the cup implement 12. The spacer 20 has a plurality of radially extending reinforcing ribs 64 integrally formed with, and extending between, the tubular portion 56 and the flange portion 58, each of the reinforcing ribs 64 projecting outward from the end of the tubular portion 56 as shown.

It should be noted that the flange portion 58 can be formed with a lip in a similar manner as described in detail hereinbelow for the retaining collar 24. The configuration of the lip provides a certain degree of flexibility to the pipeline pig 10 which allows the pipeline pig 10 to more easily pass around corners and past irregularities in the pipeline 16.

As illustrated in FIG. 1, the spacers 20 are assembled in a back-to-back relationship wherein the ends of the tubular portions 56 of the spacers 20 abut against each other and the flange portions 58 are engaged against the cup implement 12. The spacers 20 are maintained in back-to-back relationship and prevented from having a tendency to stretch out or to slip over the end of the adjacent spacer as a result of high pressures in the pipeline 16 by the reinforcing ribs 64 which extend over the ends of the tubular portions 56 of abutting spacers 20. That is, the reinforcing ribs 64 overlap the tubular portions 56 of adjacent spacers 20 when the spacers 20 are positioned in the back-to-back relationship, thereby preventing each spacer 20 from sliding over the end of the adjacent spacer.

As stated hereinabove, the body portion 50 of the cup implement 12 are configured to be interlockable with the retaining collar 24 and the spacers 20 in order to properly secure the cup implements 12. To this end, each spacer 20 is provided with a pattern of bosses or tabs 66 integrally formed about, and extending from, the flange portion 58, as shown in FIGS. 5A and 5B. The bosses 66 are spaced apart and dimensioned to be slidably received in the recesses 54 of one of the cup implements 12, as illustrated in FIG. 1.

To retain the cup implement 12 and spacers 20 securely on the body extension member 22, the retaining collar 24 is positioned over the body extension member 22 and secured thereto. The retaining collar 24 (best shown in FIG. 6A) has a tubular portion 68, a cup-shaped portion 70 and an opening 72 therethrough, and like the body extension member 22, the retaining collar 24 is preferably constructed of plastic. The opening 72 is dimensioned so that the retaining collar 24 can be slidably positioned over and fastened to body extension member 22 to securely retain the cup implements 12.

The tubular portion 68 of the retaining collar 24 is slotted from its end to form a plurality of flexible latching tabs 74 which have inwardly extending projections 76 configured to be received in the projection receiving slots 44 of the body extension member 22. The latching tabs 74 are integrally formed about the tubular portion 68 and are staggered with a plurality of support sections 7,8 disposed therebetween. The latching tabs 74 and the support sections 78 are separated by slots 80 which extend substantially across the tubular portion 68. The slots 80 permit the latching tabs 74 to flex so as to deflect outwardly so that the projections 76 can slidably pass over the flange portion 38 of the body extension member 22 so that the retaining collar 24 can be slidably positioned on, and removed from, the body extension member 22. Each support section 78 is strengthened by a reinforcing rib 82 integrally formed between the cup-shaped portion 70 and the support section 78.

Figure 6A:
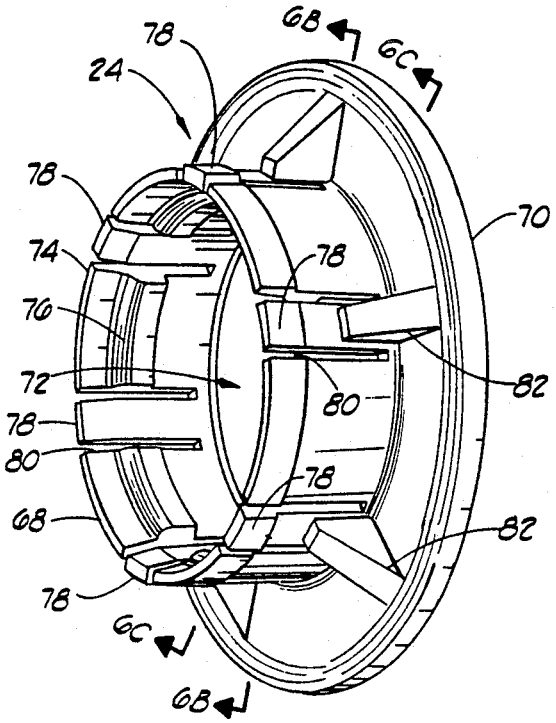
FIG. 6A is a perspective view of the retaining collar shown in FIG. 1.
Figure 6C:
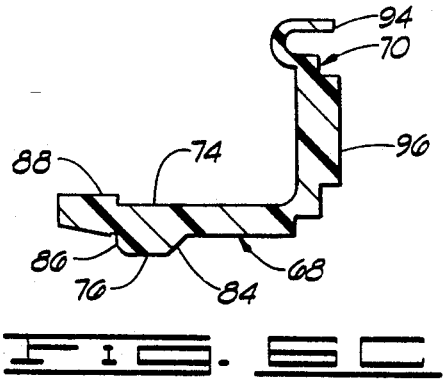
FIG. 6C is a fragmental profile along a cross section taken at 6C—6C in FIG. 6A.

The projections 76 of the latching tabs 74 are integrally formed on the interior surface of the latching tabs 74 and are alignable with the projection receiving slots 44 of the body extension member 22 when the retaining collar 24 is positioned onto the body extension member 22. Each of the projections 76 has a camming surface 84 and a latching surface 86 (FIG. 6C). The camming surfaces 84 are angled so that the latching tabs 74 are deflected outwardly when the retaining collar 24 is slidably inserted onto the body extension member 22, while the latching surfaces 86 are substantially flat radial end portions.

Figure 2:
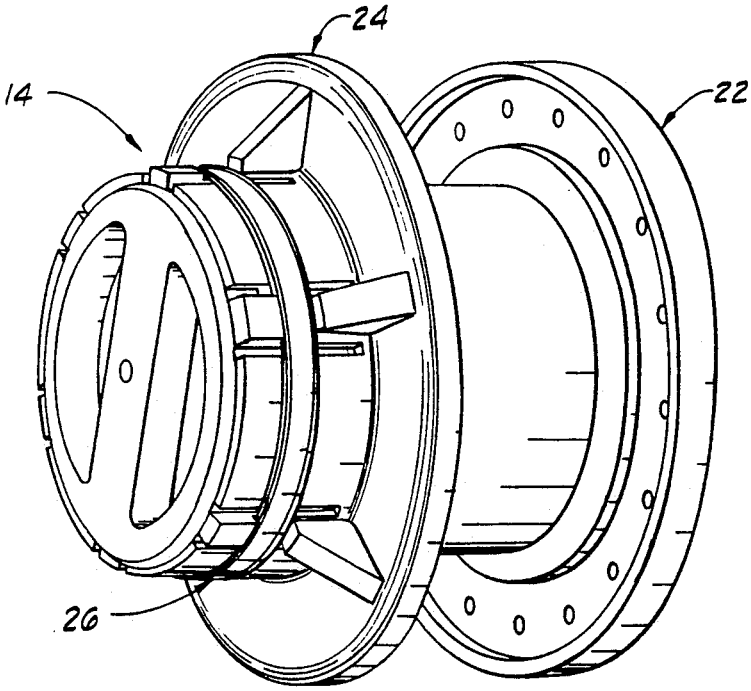
FIG. 2 is a perspective view of the assembled retaining apparatus of FIG. 1 illustrated without cup implements, spacers and ejector assembly.

To ensure that the latching tabs 74 of the retaining collar 24 do not deflect outwardly while the pipeline pig 10 is traveling through the pipeline 16, thereby unlatching the retaining collar 24, the retaining band 26 is positioned around the retaining collar 24, as shown in FIG. 2. Each support section 78 and each latching tab 74 is formed with a lip portion 88 which cooperates with the reinforcing rib 82 to define a groove 90 in which the retaining band 26 is positioned. The retaining band 26 is preferably a stainless steel strap having its ends fastened together in a suitable manner, such as with a nut and bolt (not shown).

Figure 6B:
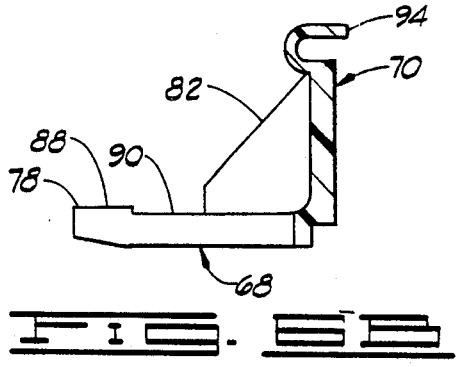
FIG. 6B is a fragmental profile along a cross section taken at 6B—6B in FIG. 6A.

As illustrated in FIGS. 6B and 6C, the cup-shaped portion 70 of the retaining collar 24 is provided with a flexible cup engaging lip 94. The outer diameter of the lip 94 is dimensioned so that it is equal to or less than the diameter of the body portions 50 of the cup implements 12. The lip 94 is further configured such that it is caused to be resiliently biased against the body portion 50 of the adjacent cup implement 12 when the retaining collar 24 is positioned onto the body extension member 22. That is, the lip 94 is configured such that it is in a flexed or coiled condition when the retaining collar 24 is on the body extension member 22. This configuration ensures that the cup implements 12 are securely maintained on the body extension member 22, while also providing the pipeline pig 10 with a certain degree of flexibility so that the pipeline pig 10 can more easily pass around corners and past irregularities in the pipeline 16.

In a like manner to the spacers 20, the retaining collar 24 is provided with a pattern of integrally formed bosses or tabs 96 (FIG. 6C). However, unlike the bosses 66 of the spacers 20, the bosses 96 of the retaining collar 24 are not dimensioned to fully extend into the recesses 54 of the cup implement 12, but rather are dimensioned to only extend substantially into the recesses 54. That is, the bosses 96 are dimensioned to be received in the recesses 54 of the adjacent cup implement 12 such that the bosses 96 securely interlock with the cup implement 12 while also allowing the flexibility of the retaining collar 24 provided by the configuration of the lip 94 to be maintained. To further aid in securing the cup implement 12 which is adjacent the flanged end portion 30 of the body extension member 22, a tubular plug (not shown) can be positioned between the flanged end portion 30 and the adjacent cup implement 12 such that the plug fits over the head of the bolt 34 and interlockingly extends into the recesses 54.

Figure 7:
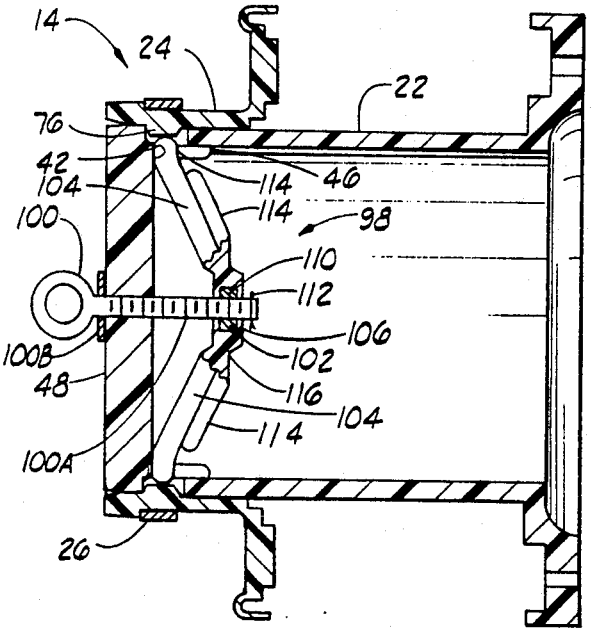
FIG. 7 is an elevational view, partially cross sectioned, of the retaining apparatus of FIG. 1 illustrating the ejector assembly.
Figure 8:
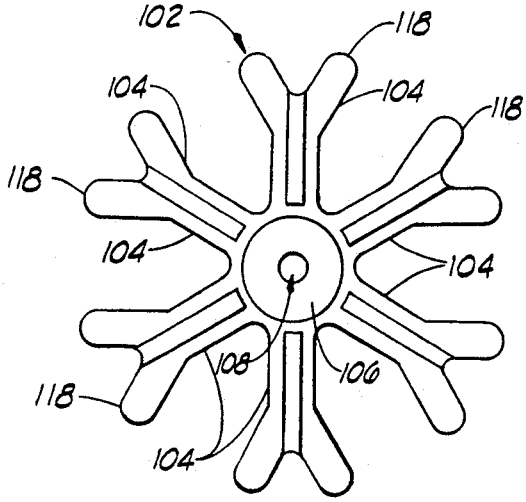
FIG. 8 is a front, elevational view of the expandable spider member of the ejector assembly shown in FIG. 7.

To unlock and remove the retaining collar 24 from the body extension member 22 so that the cup implements 12 can be removed, the projections 76 of the latching tabs 74 must be disposed to clear the projection receiving slots 44. To facilitate removal of the projections 76 from the projection receiving slots 44, the retaining apparatus 14 has an ejection assembly 98, as illustrated in FIGS. 7 and 8. The ejection assembly 98 comprises a bolt 100 and an expandable spider member 102 having a plurality of ejector fingers 104. The bolt 100, shown herein as an eyebolt, has screw threads 100A at one end and is disposed to extend through an aperture 48A through the crossbar 48 along the longitudinally axis of the body extension member 22. A washer 100B is provided between the bolt head of the bolt 100 and the crossbar 48. The spider member 102 has a central hub portion 106 from which the flexible ejector fingers 104 extend; the hub portion 106 has an aperture 108 therethrough, and a nut 110 is supported by the hub portion 106 to threadingly engage the screw threads 100A of the bolt 100. A cotter pin 112 extends through a hole in the screw threads 100A to prevent the withdrawal thereof from the nut 110.

The ejector fingers 104 are elongated, flexible members constructed of an elastic material, such as plastic, and each ejector finger 104 is provided with a rib 114 integrally formed thereon to stiffen the bodies of ejector fingers 104. As shown in FIG. 7, a hinge portion 116 is defined where the rib 114 terminates near the hub portion 106. The hinge portion 116 provides each ejector finger 104 a point of flexibility, the importance of which will become evident below. Each ejector finger 104 has a distal end 118 which is forked and engageable against the interior shoulder surface 42 of the flange portion 38 of the body extension member 22.

The ejection assembly 98 is actuated by rotation of the bolt 100 which causes, in one rotational direction, axial movement of the hub portion 106 toward the crossbar 48, moving the ejector fingers 104 toward the flange portion 38, thus causing the distal end 118 to engage the interior shoulder surface 42, of the flange portion 38. Because of the flexibility of the ejector fingers 104 at the hinge portions 116, continued rotation of the bolt 100 causes the forked distal ends 118 of the ejector fingers 104 to move outwardly along the inner shoulder surface 42 of the flange portion 38. The continued outward movement of the ejector fingers 104 causes the forked distal ends 118 of the ejector fingers 104 to engage the bottom of the projections 76 to move the projections 76 from the projection receiving slots 44 so that the retaining collar 24 can be slidably removed from the body extension member 22. In reverse fashion, rotation of the bolt 100 in the opposite rotational direction causes axial movement of the hub portion 106 away from the crossbar 48, thereby causing the ejector fingers 104 to retract from the projection receiving slots 44. The U-shaped ribs 46 integrally formed on the body extension member 22 are disposed between the forked distal ends 118 of the ejector fingers 104 and serve to maintain the ejector fingers 104 in operable alignment with the projection receiving slots 44.

Figure 9:
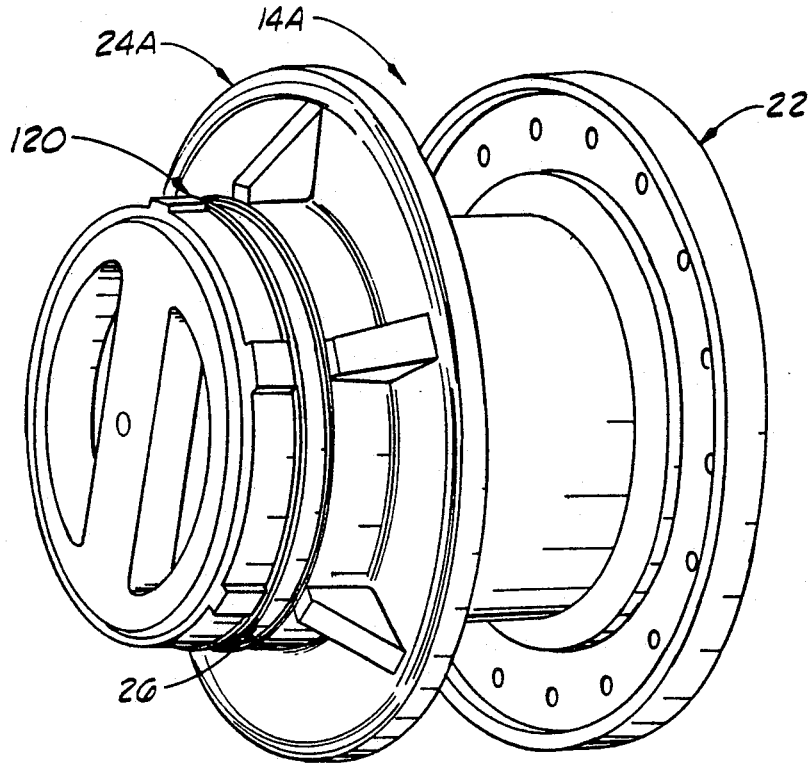
FIG. 9 is a perspective view of another embodiment of a retaining apparatus constructed in accordance with the present invention illustrated without cup implements and spacers.
Figure 10:
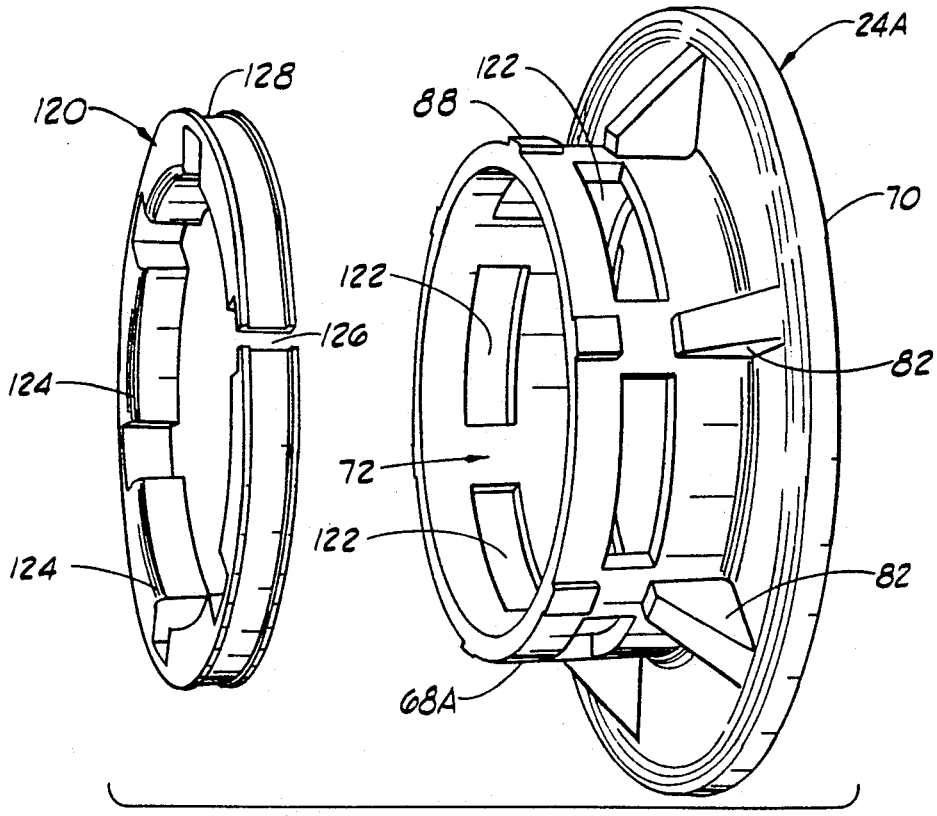
FIG. 10 is an exploded, perspective view of the retaining collar and the latch member of the retaining apparatus of FIG. 9.

Referring now to FIGS. 9–10, another embodiment of a retaining apparatus 14A of the present invention is illustrated. The retaining apparatus 14A comprises the body extension member 22 and the retaining band 26 as described above in reference to the retaining apparatus 14, and further includes a retaining collar 24A and a latch member 120.

The retaining collar 24A, similar to the retaining collar 24, functions to retain the cup implements 12 and the spacers 20 on the body extension member 22. However, the manner in which the retaining collar 24A is secured on the body extension member 22 differs as will be described below.

As shown in FIG. 10, the retaining collar 24A having the opening 72 includes the cup-shaped portion 70 and a tubular portion 68A. The opening 72 is dimensioned so that the retaining collar 24A can be slidably positioned on the body extension member 22, thus allowing the cup shaped portion 70 to engage the cup implements 12. To retain the cup implements 12, the retaining collar 24A is adapted to be securely fastened to the body extension member 22. That is, the tubular portion 68A is provided with a plurality of projection receiving slots 122 formed thereabout which are alignable with the projection receiving slots 44 of the body extension member 22 when the retaining collar 24A is positioned on the body extension member 22.

The latch member 120 has a plurality of inwardly extending projections or tabs 124 and is employed to fasten the retaining collar 24A to the body extension member 22. The projections 124 are integrally formed on the inner surface of the latch member 120 and are spaced apart so as to be insertable into the projection receiving slots 122 of the retaining collar 24A. Further, the projections 124 are dimensioned so that they simultaneously extend into the projection receiving slots 44 to fasten the retaining collar 24A to the body extension member 22. The latch member 120 is preferably constructed of an elastic material, such as plastic, formed into the shape of a ring having an inner diameter which allows the latch member 120 to be disposed about the tubular portion 68A of the retaining collar 24A.

To facilitate disposing the latch member 120 about the retaining collar 24A, the latch member 120 is provided with a cut 126 which enables the latch member 120 to be flexibly expanded about the retaining collar 24A so that the projections 124 can be inserted into the projection receiving slots 122 and 44.

The latch member 120 is secured about the retaining collar 24A by the retaining band 26 (FIG. 9) in a like manner as described hereinabove for retaining the latching tabs 74 of the retaining collar 24. The retaining band 26 is positioned around the latch member 120 in a groove 128 which is defined about the perimeter of the latch member 120.

As previously stated, the retaining apparatus 14 and 14A of the present invention are preferably constructed of any moldable and durable material, such as plastic (excluding the nuts and bolts and the retaining band). The use of such a material permits the components of the retaining apparatus 14 and 14A to be integrally formed, thus making the assembly and disassembly of the pipeline pig 10 more efficient. Furthermore, employment of the present invention on the pipeline pig 10 improves the operational efficiency of the pipeline pig since it is lighter in weight and more flexible than prior art devices.

From the above description it is clear that the present invention is well adapted to carry out the objects and to attain the ends and advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. An improved retaining apparatus for a pipeline pig having at least one pig implement dimensioned to engage the internal wall of a pipeline, the pipeline pig having a pig body member, the apparatus comprising:

a body extension member adapted to support at least one pig implement and having one end adapted to be connected to the pig body member;

retaining collar means positionable over the body extension member for securing the pig implement on the body extension member; and locking means for securing the retaining collar means on the body extension member, the locking means comprising:

latch means integrally formed with the retaining collar means for fastening the retaining collar means to the body extension member; and means for securing the latch means in a securing relationship to the retaining collar means.

2. The retaining apparatus of claim 1 wherein the body extension member is provided with a plurality of spaced apart projection receiving slots formed thereabout, and wherein the latch means comprises a plurality of spaced apart flexible latching tabs integrally formed about the retaining collar having inwardly extending projections configured to be latchingly engaged with the projection receiving slots of the body extension member when the retaining collar is positioned thereon.

3. The retaining apparatus of claim 2 wherein the means for securing the latch means is a band secured around the latching tabs of the latch means.

4. The retaining apparatus of claim 3 further comprising:

ejector means for moving the projections of the latching tabs from engagement with the projection receiving slots so that the retaining collar can be removed from the body extension member.

5. The retaining apparatus of claim 4 wherein the body extension member has a crossbar traversing a second end of the body extension member and wherein the ejector means comprises:

a spider member having a centrally disposed hub portion with a plurality of ejector fingers attached thereto and radially extending therefrom, each ejector finger having a distal end portion slidably engageable against the body extension member, the hub having a centrally disposed threaded nut portion; and a bolt member supported by the crossbar and having a threaded end thereof in threaded engagement with the nut portion of the hub of the spider member, the ejector members expandable radially outwardly or inwardly in response to rotation of the bolt member so that the outward movement thereof moves the projections of the latching tabs out of the projection receiving slots.

6. The retaining apparatus of claim 5 wherein the body extension member further comprises:

guide means for maintaining the ejector fingers in operable alignment with the projection receiving slots.

7. An improved retaining apparatus for a pipeline pig having at least one pig implement dimensioned to engage the internal wall of a pipeline, the pipeline pig having a pig body member, the apparatus comprising:

a body extension member adapted to support at least one pig implement and having one end adapted to be connected to the pig body member;

retaining collar means positionable over the body extension member for securing the pig implement on the body extension member, the retaining collar means comprising:

a plurality of projection receiving slots formed thereabout which are alignable with the projection receiving slots of the body extension member when the retaining collar is positioned thereon; and locking means for securing the retaining collar means on the body extension member, the locking means comprising:

latch means positionable about the retaining collar having a plurality of inwardly extending projections latchingly positionable in the projection receiving slots of the retaining collar and the body extension member so as to fasten the retaining collar to the body extension member; and means for securing the latch member about the retaining collar.

8. The retaining apparatus of claim 7 wherein the means for securing the latch member is a band secured around the latch member.

9. An improved retaining apparatus for a pipeline pig having at least one pig implement dimensioned to engage the internal wall of a pipeline, the pipeline pig having a pig body member, the apparatus comprising:

a body extension member adapted to support at least one pig implement and having one end adapted to be connected to the pig body member, the pig implement having a pattern of recesses thereon;

retaining collar means positionable over the body extension member for securing the pig implement on the body extension member, the retaining collar means comprising:

a retaining collar supportable by the body extension member and secured by the locking means to engage the pig implement, the retaining collar having a pattern of bosses which matingly interlock with the recesses of the pig implement; and locking means for securing the retaining collar means on the body extension member.

10. The retaining apparatus of claim 9 wherein plural pig implements are supported on the body extension member and are secured thereon by the cooperation of the retaining collar and the body extension member, the retaining apparatus further comprises:

spacer means for spacing the pig implements on the body extension member, each spacer means disposed between adjacent pig implements.

11. The retaining apparatus of claim 10 wherein each spacer means comprises:

a first spacer member positioned to abut one of the pig implements; and a second spacer member positioned to abut an adjacent one of the pig implements, each pig implement having a pattern of recesses formed therein, and each spacer member having a pattern of bosses which matingly interlock with the recesses of one of the pig implements.

12. The retaining apparatus of claim 11 wherein the first spacer member and the second spacer member have overlapping portions to maintain the spacer members in abutting and overlapping relationship.

13. In a pipeline pig having at least one pig implement dimensioned to engage the internal wall of a pipeline, the pipeline pig having a body member, an improved retaining apparatus comprising:

a body extension member adapted to receive at least one pig implement and having a first end adapted to be connected to the body member of the pipeline pig and a second end with a plurality of spaced apart projection receiving slots formed thereabout;

a retaining collar having an opening therethrough dimensioned such that the retaining collar is positionable over the body extension member so as to secure the pig implement on the body extension member, and having a plurality of spaced apart flexible latching tabs with inwardly extending projections which are configured to be latchingly engaged with the projection receiving slots when the retaining collar is inserted onto the body extension member; and retaining means secured about the retaining collar for preventing the outward deflection of the latching tabs of the retaining collar when the retaining collar is positioned on the body extension member.

14. The retaining apparatus of claim 13 wherein the retaining means is a band secured around the latching tabs of the retaining collar.

15. The retaining apparatus of claim 14 further comprising:

ejector means for forcing the projections of the latching tabs from engagement with the projection receiving slots so that the retaining collar can be removed from the body extension member.

16. The retaining apparatus of claim 15 wherein the body extension member has a shoulder portion at a second end of the body extension member, and wherein the ejector means comprises:

a spider member having a centrally disposed hub portion with a plurality of ejector fingers attached thereto, and radially extending therefrom, each ejector finger having a distal end portion slidably engageable against the shoulder portion of the body extension member, the hub having a centrally disposed threaded nut portion; and a bolt member supported by the body extension member and having a threaded end thereof in threaded engagement with the nut portion of the hub of the spider member, the ejector members expandable radially outwardly or inwardly in response to rotation of the bolt member so that the outward movement thereof moves the projections of the latching tabs out of the projection receiving slots.

17. The retaining apparatus of claim 16 wherein the body extension member further comprises:

guide means for maintaining the ejector fingers in operable alignment with the projection receiving slots.

18. The retaining apparatus of claim 13 wherein the retaining collar is provided with a flexible lip which is resiliently biased against the pig implement when the retaining collar is secured on the body extension member.

19. In a pipeline pig having at least one pig implement dimensioned to engage the internal wall of a pipeline, the pipeline pig having a body member, an improved retaining apparatus comprising:

a body extension member adapted to receive at least one pig implement and having a first end adapted to be connected to the body member of the pipeline pig and a second end with a plurality of spaced apart projection receiving slots formed thereabout;

retaining collar having an opening therethrough dimensioned such that the retaining collar is positionable over the body extension member so as to secure the pig implement on the body extension member, and having a plurality of spaced apart projection receiving slots formed thereabout alignable with the projection receiving slots of the body extension member when the retaining collar is positioned on the body extension member; and locking means engageable with the aligned projection receiving slots for locking the retaining collar on the body extension member.

20. The retaining apparatus of claim 19 wherein the locking means comprises:

a latch member positionable about the retaining collar having a plurality of inwardly extending projections latchingly positionable in the projection receiving slots of the retaining collar and the body extension member so as to fasten the retaining collar to the body extension member; and means for securing the latch member about the retaining collar.

21. The retaining apparatus of claim 20 wherein the means for securing the latch member is a band secured around the latch member.

22. The retaining apparatus of claim 19 wherein the retaining collar is provided with a flexible lip which is resiliently biased against the pig implement when the retaining collar is secured on the body extension member.

23. A pipeline pig for use in a pipeline having an internal wall, comprising:

a pig body member;

a body extension member connected at one end to the pig body member, the body extension member having a plurality of spaced apart projection receiving slots formed about a second end;

a plurality of pig implements dimensioned to engage the internal wall of the pipeline and having an opening therethrough dimensioned such that the pig implements are positionable over the body extension member, each pig implement having an interlocking pattern of recesses;

spacer means for spacing the pig implements on the body extension member, each spacer means disposed between adjacent pig implements, each spacer means comprising:

a first spacer member positioned to abut one of the pig implements; and a second spacer member positioned to abut an adjacent one of the pig implements, each spacer member having a pattern of bosses which matingly interlock with recesses of one of the pig implements, and each spacer member having overlapping portions to maintain the spacer members in abutting and overlapping relationship; and a retaining collar having an opening therethrough dimensioned such that the retaining collar is positionable over the body extension member so as to secure the pig implements on the body extension member, the retaining collar adapted to be latchingly secured in the projection receiving slots of the body extension member, and the retaining collar having a pattern of bosses which matingly interlock with the recesses of an adjacent one of the pig implements.

24. A pipeline pig for use in a pipeline having an internal wall, comprising:

a pig body member having a first end and a second end;

a first body extension member connected at one end to the first end of the pig body member;

a second body extension member connected at one end to the second end of the pig body member, the first and second body extension members each having a plurality of spaced apart projection receiving slots formed about a second end;

a plurality of pig implements dimensioned to engage the internal wall of the pipeline and having an opening therethrough dimensioned such that the pig implements are positionable over either one of the first and second body extension members, each pig implement having an interlocking pattern of recesses;

spacer means for spacing the pig implements on each one of the body extension members, each spacer means disposed between adjacent pig implements, each spacer means comprises:

a first spacer member positioned to abut one of the pig implements; and a second spacer member positioned to abut an adjacent one of the pig implements, each spacer member having a pattern of bosses which matingly interlock with recesses of one of the pig implements, and each spacer member having overlapping portions to maintain the spacer members in abutting, back-to-back relationship;

a first retaining collar having an opening therethrough dimensioned such that the first retaining collar is positionable over the first body extension member so as to secure the pig implements on the first body extension member; and a second retaining collar having an opening therethrough dimensioned such that the second retaining collar is positionable over the second body extension member so as to secure the pig implements on the second body extension member, the first and second retaining collar each adapted to be latchingly secured in the projection receiving slots of the first and second body extension members, respectively, and each retaining collar having a pattern of bosses which matingly interlock with the recesses of an adjacent one of the pig implements.

25. In a pipeline pig having at least one pig implement supported for engagement with the internal wall of a pipeline and retained by a retaining collar, the improvement comprising:

interlocking means for interlocking the pig implements and the retaining collar, the interlocking means comprising:

an interlocking pattern of bosses supported by the retaining collar; and an interlocking pattern of recesses supported by the pig implement, the interlocking patterns of the retaining collar and of the pig implement being interlockable to secure the retaining collar and the pig implement in locked engagement.

26. An improved pig implement of the type secured on a pipeline pig with a retaining collar having a pattern of bosses extending therefrom, the improvement comprising:

a pig implement having a body portion supported by the pipeline pig and having a pipeline engaging portion extending therefrom, having a pattern of recesses which are interlockable with the bosses of the retaining collar.

27. In an improved pipeline pig for use in a pipeline, the improvement comprising:

a plurality of pig implements, each having a body portion supported by the pipeline pig and having a pipeline engaging portion extending therefrom, the body portion having a pattern of recesses;

a plurality of spacer members positioned to space the pig implements on the pipeline pig, each spacer member supported by the pipeline pig and having a pig implement engaging flange portion, the flange portion having a pattern of bosses interlockable with the recesses of an adjacent one of the pig implements;

a retaining collar supported by the pipeline pig and having a pig implement engaging portion, the pig implement engaging portion having a pattern of bosses which are interlockable with the recesses of an adjacent one of the pig implements.

28. The pipeline pig of claim 27 wherein the spacer members have overlapping portions to maintain the spacer members in abutting and overlapping relationship.

* * * * *